US005301626A

United States Patent [19]

Penny

[11] Patent Number: 5,301,626

[45] Date of Patent: Apr. 12, 1994

[54] CARGO HATCH COVER MECHANISM

[75] Inventor: Donald A. Penny, Ocean Springs, Miss.

[73] Assignee: The Main Deck, Inc., Ocean Springs, Miss.

[21] Appl. No.: 996,678

[22] Filed: Dec. 24, 1992

[51] Int. Cl.[5] ..... B63B 19/18

[52] U.S. Cl. ..... 114/202; 114/201 R

[58] Field of Search ..... 114/201 R, 201 A, 202, 114/203; 464/32, 33; 160/188; 105/377

[56] References Cited

U.S. PATENT DOCUMENTS

| | | | |
|---|---|---|---|
| 1,795,786 | 3/1931 | Lovett | 114/201 R |
| 2,256,087 | 9/1941 | Hay | 114/201 |
| 2,585,113 | 2/1952 | Gredell | 464/32 |
| 2,737,919 | 3/1956 | McRae | 114/202 |
| 2,891,500 | 6/1959 | Appleton et al. | 114/202 |
| 3,050,026 | 8/1962 | Ligh | 114/202 |
| 3,077,225 | 2/1963 | Aarvold | 160/188 |
| 3,104,643 | 9/1963 | Vallet | 114/202 |
| 3,154,136 | 10/1964 | Ligh | 114/201 R |
| 3,211,122 | 10/1965 | Barlow | 114/202 |
| 4,347,715 | 9/1982 | Carman et al. | 464/32 |
| 4,447,217 | 5/1984 | Blandford | 464/32 |

FOREIGN PATENT DOCUMENTS

| | | |
|---|---|---|
| 241030 | 8/1959 | Australia . |
| 644496 | 6/1964 | Belgium . |
| 97330 | 11/1963 | Denmark . |
| 1506251 | 6/1969 | Fed. Rep. of Germany . |
| 199789 | 10/1985 | Japan . |
| 221194 | 1/1958 | Sweden . |

*Primary Examiner*—Andres Kashnikow
*Assistant Examiner*—Stephen P. Avila
*Attorney, Agent, or Firm*—Hopkins & Thomas

[57] ABSTRACT

A cargo hatch cover actuation mechanism. At least one fixed unilateral mechanical actuator is mounted on a cargo hatch cover panel. The actuator is driven by an electric motor, and controlled by a hand controller, attached to the end of a flexible electrical cable which can be moved about to any suitable position near the hatch.

13 Claims, 4 Drawing Sheets

CARGO HATCH COVER MECHANISM

BACKGROUND OF THE INVENTION

This invention relates to the field of ship cargo hatch covers, and mechanisms for opening and closing such covers.

It is impossible to exaggerate the importance of cargo hatch covers to the safety, watertight integrity and operability of a ship. Crew safety and ship survival may depend on how well hatch covers operate.

Hatch Cover actuation mechanisms fall into the category of cargo access equipment. Such actuators are shown in, for example:

U.S. Pat. No. 3,211,122 to Barlow discloses a power operated hatch cover mechanism in which a spaced pair of rotary hydraulic actuators pivot cargo hatch panels through gears.

U.S. Pat. No. 3,104,643 to Vallet discloses a hydraulic cylinder system for opening or locking a closed hatch cover. The hydraulic cylinder is suspended between two pivot points under one of two opposed hatch covers.

U.S. Pat. No. 3,077,225 to Aarvold, in disclosing a design for the hinges of a cargo hatch cover, shows the use of a hydraulic motor for opening and closing the hatch cover.

U.S. Pat. No. 3,050,026 to Ligh shows an opening system involving two coordinated hydraulic actuators.

U.S. Pat. No. 2,891,500 to Appleton shows a combined hydraulic and cable system to open the hatch covers. This system results in extensive cable runs across the cargo deck.

U.S. Pat. No. 2,737,919 to McRae discloses a system having a multiplicity of relatively narrow hatch covers which individually can be rotated to a vertical or horizontal position and, in a vertical position, may be moved along the hatch by motors and gears.

German patent 1,506,251 discloses a hydraulic hatch cover with self contained hydraulics beneath the hatch cover.

Swedish patent 221194 discloses a mechanical, gear driven on track hatch cover actuator which appears to be a variant on a "single pull MacGregor" system, a cable pull system in which a cable is reeved through all the wheels supporting all the hatch cover panels, and used to pull the covers to a removed position.

Belgian patent 644496 appears to discloses a cargo hatch cover actuation mechanism comprising a belt driven gear, affixed to hinges to fold adjacent covers about said hinges.

Japanese patent 199789 appears to disclose a hydraulically actuated cargo hatch cover mechanism Australian patent 241030 discloses a hydraulic hatch cover actuating mechanism, with hinging to maximize closing force near the cover closed position.

Danish patent 97330 discloses an actuating mechanism in which a freely pivoted hydraulic cylinder bears on a link, which is pivotally attached to two interlocked gears, each fixed to a hatch cover section, causing the gear to pivot around each other as a hinge.

The principal objection to the use of exposed hydraulic is the possible contamination of bulk cargos, especially grains, from hydraulic fluid leakage. Since hydraulic systems are uncommon aboard ship, few ships have on board maintenance capabilities for such systems, and such leaks and failures become increasingly common as ship systems age.

An equally serious objection is the consequences of system failure; loss of hydraulic pressure can result in a sudden fall of the hatch covers. Since a hatch cover is a large, heavy metal object, damage by a falling hatch cover can be severe, and may result in structural damage to the ship hull if the cover falls into the hold. Cable driven systems likewise can collapse if the cable snaps. Such failure additionally can result in cable whiplash, which endangers all crew.

SUMMARY OF THE INVENTION

This invention pertains to cargo hatch opening mechanisms for ship board use, and shows a cargo hatch actuating mechanism that avoids the principal problems of the prior art mechanisms by avoiding any use of hydraulic, cable and chain driven systems. At least one fixed unilateral mechanical actuator is mounted on a cargo hatch cover panel. The actuator is driven by an electric motor, and controlled by a hand controller, attached to the end of a flexible electrical cable which can be moved about to any suitable position near the hatch. This permits local operation of the hatch covers by an operator having direct view of all aspects of the motion of the hatch cover.

Each such actuator drives a cam actuated hinge connecting the panel to an adjacent panel, and, through the action of the cam actuated hinge, folds the pair of panels up into a vertical stowed position, opening the hatch, or extends the pair panels flat covering the hatch opening. Adjacent pairs of panels may be similarly equipped, providing a multi-panel system.

Throughout the motion of the unilateral mechanical actuator, the covers are positively supported; failure of a unilateral mechanical actuator simply results in no further motion of the covers. Since a unilateral mechanical actuator is positively and mechanically fixed in position at any extension, and since such a mechanism cannot be driven backwards, that is, no force exerted at the actuator end will cause the unilateral mechanical actuator to retract or extend, the cargo hatch covers are at all times positively supported.

To insure uniform lifting force on the cargo hatch hinges, if more than one unilateral mechanical actuator is used for a panel pair, all are driven by a single electric motor, through a reduction gear, driving each unilateral mechanical actuator through direct drive shafts. All driving motions on the unilateral mechanical actuators are thus identical, and the extension of each actuator is uniform.

The preferred motive power source is an electric motor mounted on the same cargo hatch cover panel as the unilateral mechanical actuator. This permits controlled opening and closing of a cargo hatch by direct control by individual hand controllers connected to the motor control by a flexible electrical cable. No central hydraulic or fluid power generation and distribution is required, and there is no possibility of fluid leaks into the cargo, nor is there any failure mode involving chains or cables which would result in the un-commanded fall of an unsupported hatch cover, as can happen with failures in hydraulic, chain or cable systems. Further, a manually powered crank can be used to raise or lower the covers in an emergency, by providing a mechanical drive coupling through the motor, for use during power failure or in the event of motor failure.

It is thus an object of the invention to disclose a ship cargo hatch cover actuation system which avoids the use of hydraulic piping or chain or cable mechanisms within the cargo holds.

It is a further object of the invention to disclose a ship cargo hatch cover actuation system in which there is no possibility of contamination of ship cargos from hydraulic fluids.

It is a further object of the invention to disclose a ship cargo hatch cover actuation system which provides a positive mechanical lock of the hatch cover position at any point in raising or lowering same.

It is a further object of the invention to disclose a ship cargo hatch cover actuation system which does not require central fluid poser generation or piping for motive power.

It is a further object of the invention to disclose a ship cargo hatch cover actuation system which is capable of manual activation in an emergency situation.

These and further objects of the invention will be apparent from the detailed embodiment disclosed below.

DETAILED DESCRIPTION OF THE INVENTION

Figure 1:
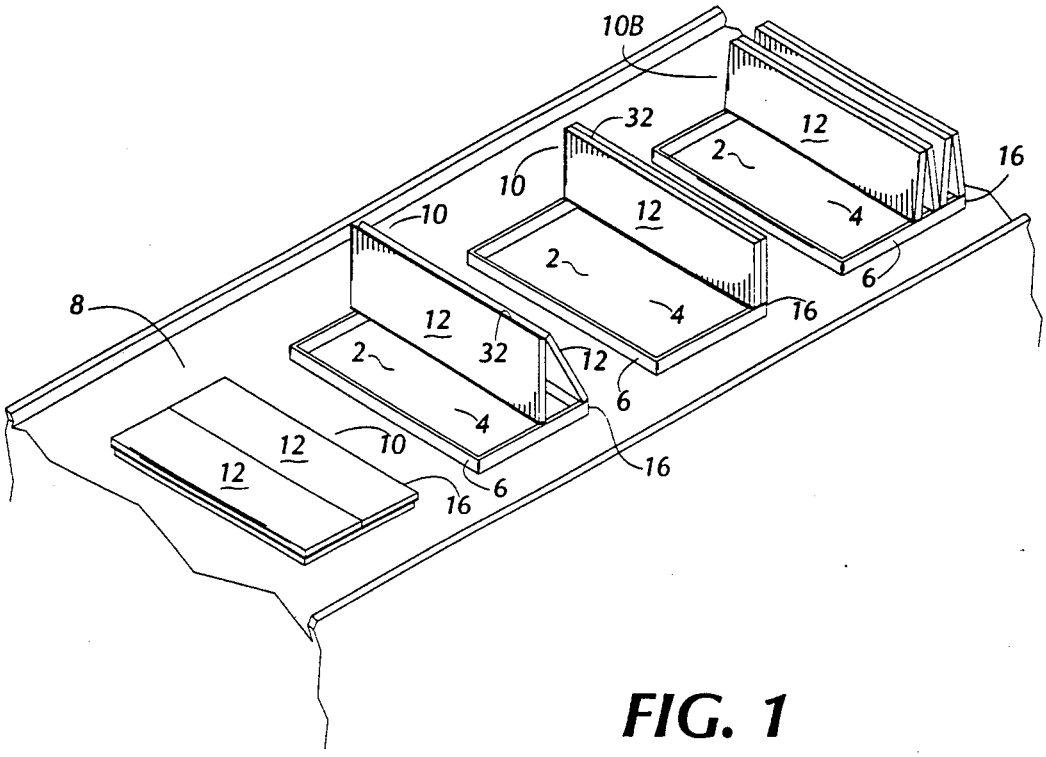
FIG. 1 is a view of a ship showing cargo hatches and covers in closed, opening and open positions.
Figure 2:
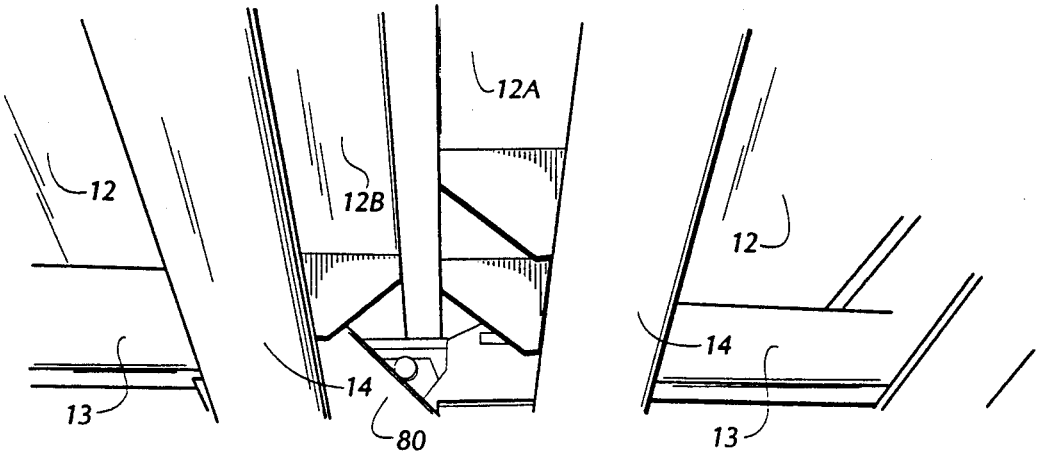
FIG. 2 is a under side view of the panels of the invention in closed position.
Figure 3:
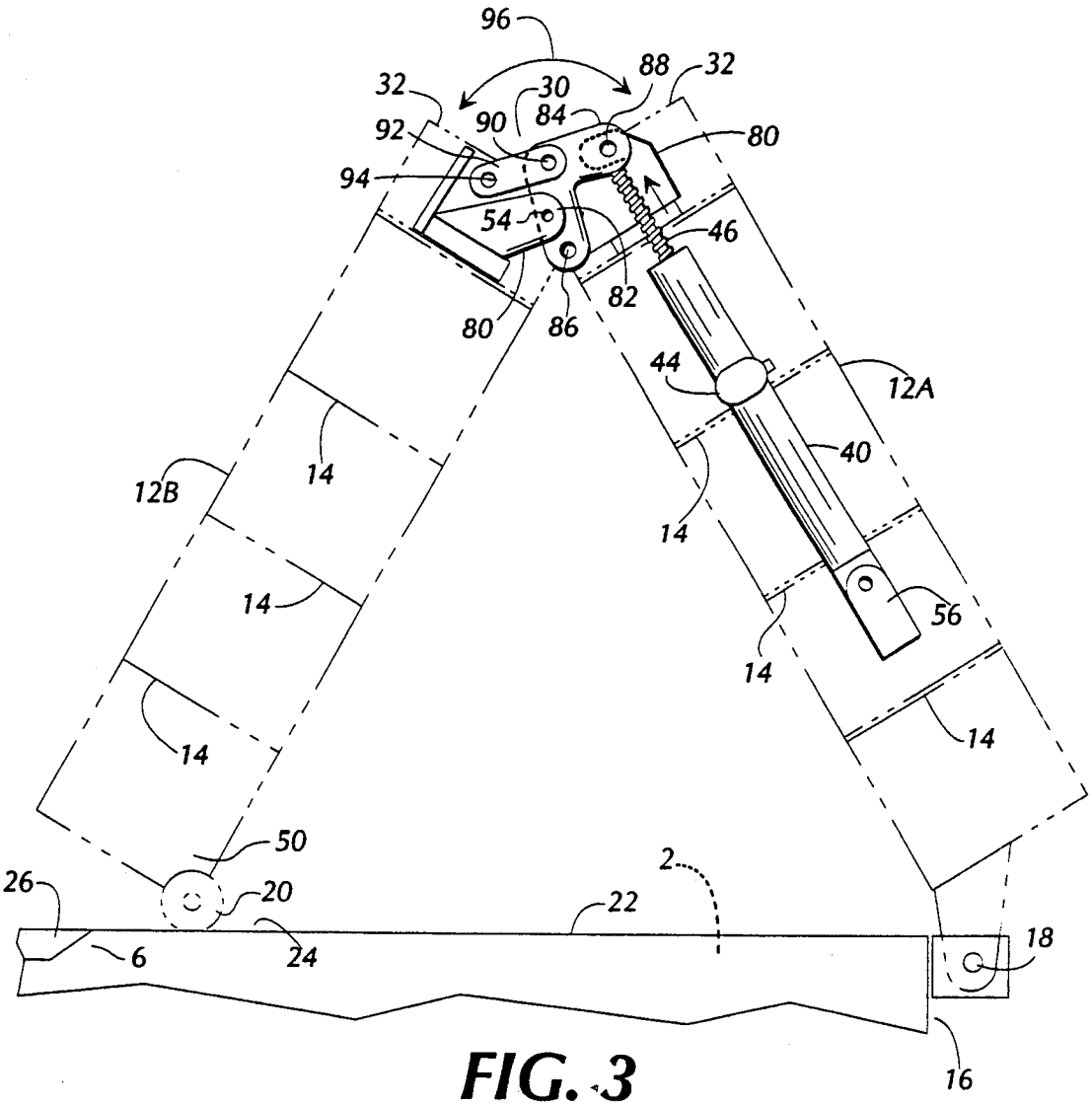
FIG. 3 is a side view of an embodiment of the invention in opening position.
Figure 4:
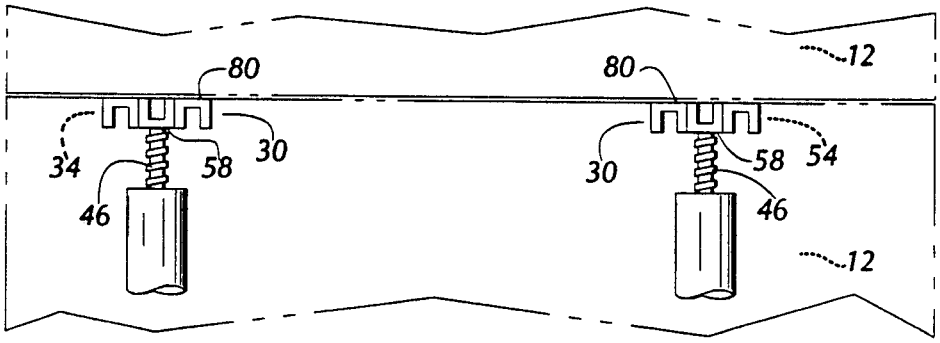
FIG. 4 is a under side view of a cargo hatch cover panel.
Figure 5:
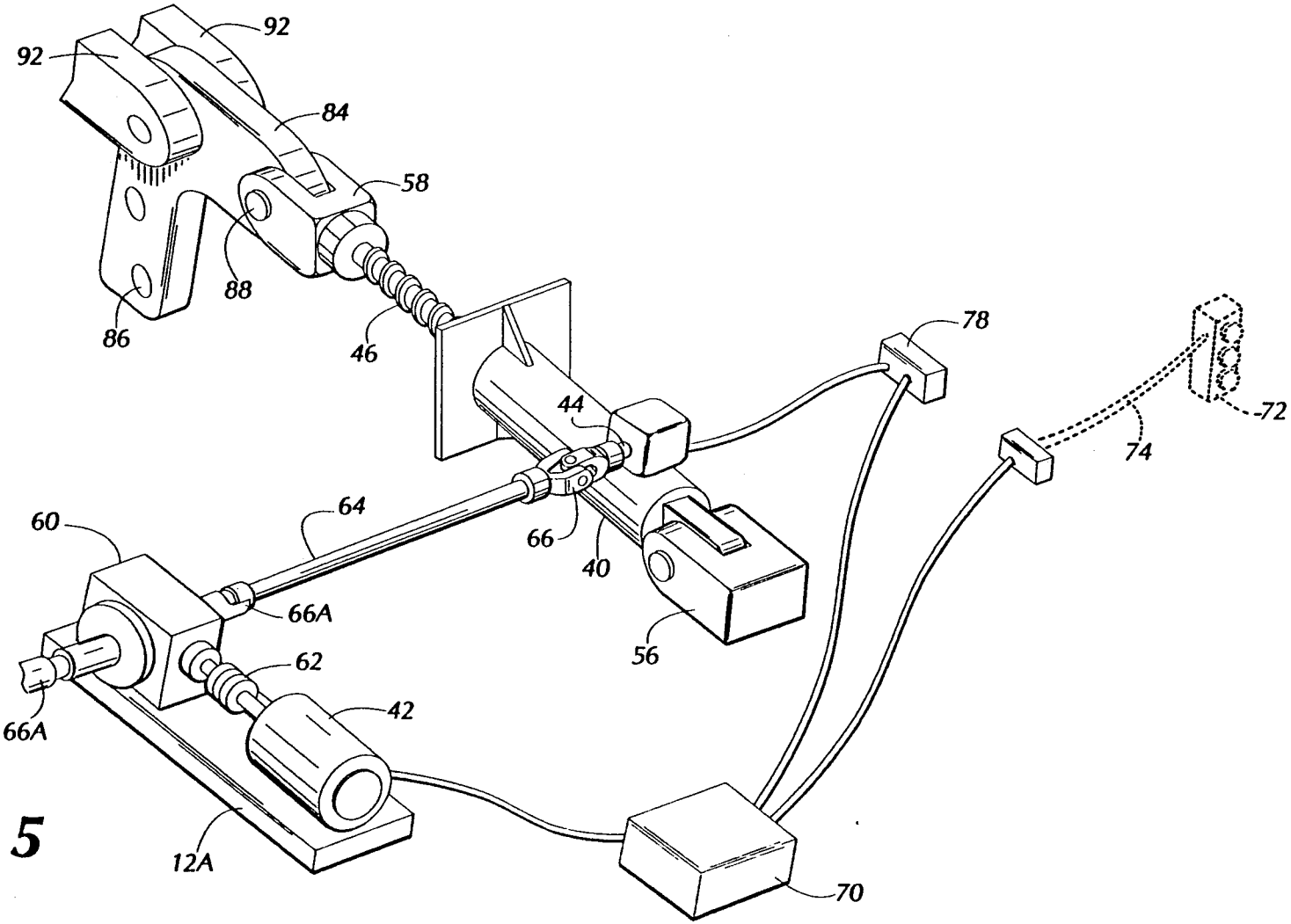
FIG. 5 is a view of the interconnection of the components of the invention
Figure 6:
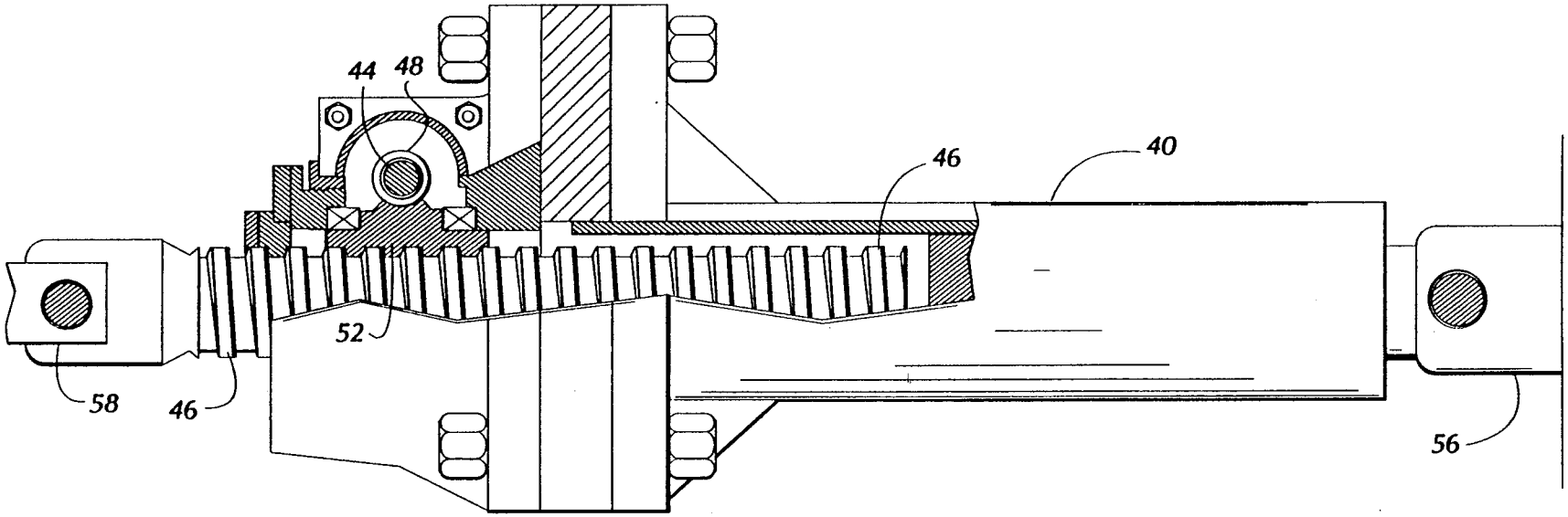
FIG. 6 is a cut away view of the unilateral mechanical actuator of the invention.

In a typical ship cargo hold 2, cargo access is provided through one or more hatch openings 4, usually set above deck level by a hatch coaming 6 rising from the ship's deck 8. This coaming 6 protects the hold 4 from the easy ingress of foreign objects or sea water when the hatch is open. The cargo hold 2 is closed by a hatch cover 10, made of a series of panels 12, fitted over the hatch opening, which form a closed upper cover 10 for the cargo hold 2. Seals are maintained between the cover panel and the hatch coaming when closed, to prevent water leaks into the hold.

Since a cargo hatch cover 10 must have sufficient strength to resist the actions of the sea on the vessel, including the force of breaking seas, the covers are made of heavy steel panels 12, well reinforced by internal flanges 13 and internal cross beams 14. Opening and closing such cover panels safely and effectively is not trivial. The invention is a mechanism which provides positive positioning of hatch cover panels in all positions from closed, through intermediate to the open position, with positive locking of the panel position and without the use of hydraulic, chain or cable systems.

The invention is illustrated and described here in the form of a panel opening mechanism for two adjoining cargo hatch cover panels over a cargo hold. This exemplar embodiment may be extended to form a multi panel, end folding cover 10B. Since it is known how multi-panel assemblies may be generalized from a two panel configuration, the example here given is, for simplicity, shown as a two panel configuration. It will be apparent to those skilled in the art how equivalent structures may be constructed for multi panels as well as side opening panels. It should be apparent that the disclosed invention is applicable to any number of folding hatch cover panels, whether mounted along the length-wise axis of the vessel or mounted to be opened from side to side.

In the inventive mechanism, a first cargo hatch cover panel 12A is mounted on the stowage end 16 of the hold 2, the end where the open hatch cover panels are to be stowed. This first panel 12A is attached to the hatch coaming 6 or deck 8 by hinges 18 so that the first panel 12A can be pivoted from a lowered closed position to a vertically raised open position. In general, for all hatch covers, an end panel is hinged, on a stowage end of the hatch, usually to the coaming of the hatch or deck, and all other panels 12B, each connected by hinges to its adjacent panel 12A, are supported by wheels 20 on both sides, the wheels riding on or in tracks 22. In this example, the second panel 12B is supported by wheels 20 which ride on wheel tracks 22 which extend along each side of the hatch coaming 6. Both tracks 22 have an upper wheel supporting edge 24 which is substantially horizontal. In the example here shown, the track smoothly descends near the end of the hatch to a lower step level 26. Depending on the configuration of a specific hatch cover panel, the wheel tracks may be raised, or flat or integral with the hatch coaming sides.

The second hatch cover panel 12B is mounted over the coaming 6 adjacent the first cover panel 12A. At least one cam actuated hinge 30, and sufficient secondary hinges for support, connect adjacent ends 32 of the second and first cover panels 12, so that they fold with respect to one another. For each such cam actuated hinge 30, a unilateral mechanical actuator 40 is mounted on one panel 12, and drives its respective cam actuated hinge 30 so that the two adjacent panels 12 fold up into a stowed position at the stowage end 16 of the hatch, or extend flat to a position covering the hatch opening.

The usual hatch cover has two or three cam actuated hinges 30 connecting adjacent panels 12. In addition to these hinges 30, secondary hinges (not shown) may also be provided for strength or stability. The number of cam actuated hinges and secondary hinges depends upon the weight and configuration of the hatch cover 10.

As previously stated the first driven panel 12A is supported at the stowage end 16 of the hatch by support hinges 18. The remaining panels 12 are supported by wheels 20 which ride on wheel tracks 22 running along the top of the coaming 6. In this two panel example, the wheels 20 are mounted on the sides 50 of the second panel 12B, near the end opposite the support hinges 18. These wheels 20 may have flanges to prevent the wheels from derailing.

It is an essential element of the invention that a mechanical actuator having a unilateral positioning mechanism 40 acts on the cam actuated hinge 30 to fold the panels 12, without the use of hydraulic fluid, chain or cable systems. Since all vessels have trained electrical personnel to service ship systems, this mechanical actuator 40 is powered by electric motor 42, so that the entire mechanism is within the maintenance capability of on board personnel and equipment.

The phrase unilateral mechanical actuator 40 means a mechanically driven positioning actuator having a drive input 44 where mechanical motion is applied to position the actuator and a driven output 46, here a driven extension output, which is positioned in response to the input motion, but where mechanical force applied to the output does not result in motion of or change the position of the actuator extension. Such actuators typically involve a worm screw 48 and gear drive 52, where the worm 48 will rotate the gear 52 cannot turn the worm 48.

The preferred form of unilateral mechanical actuator 40 is a worm driven screw mechanism. In the example embodiment, for each cam actuated hinge 30, there is mounted to the underside of the first hatch cover panel 12A such a worm driven mechanism 40, fixed to the hatch cover panel 12A at right angles to the axis 54 of the hinge and aligned with the hinge 30. This actuator 40 is mounted to the panel 12A through a clevis fitting 56 at its base, and is attached to the cam actuated hinge 30 by a upper yoke 58 on its extension shaft.

The worm driven screw 48 is mechanically driven through a right angle drive shaft, and provides a considerable mechanical advantage to its extension shaft 46, which extends or retracts as the drive shaft 44 turns. The example unilateral mechanical actuator is driven by rotating a worm 48 against a gear 52, which in turn rotates a second screw 46, which forms the extension shaft. The application of driving forces in such a device is unilateral; rotation of the drive shaft 44 results in movement of the extension shaft 46, but no force on the extension shaft 46 will move the extension shaft 46 or rotate the input drive mechanism 44. As a result, the unilateral mechanical actuator 40 is positively mechanically locked in any position against compressive or tension forces along the extension shaft 46.

It will be understood that such worm driven mechanical actuators 40 may be of many various configurations, although a worm and gear mechanism is preferred for both its mechanical advantage, and its strength of resistance against reverse motion.

The cover panels 12 are lowered by retracting the extension shaft 46 of the unilateral mechanical actuator 40, which pulls the cam actuated hinge 30 to a flat position. Throughout, the position of the cam actuated hinges 30, and thus of the cover panels 12, is positively maintained by the extended position of the unilateral mechanical actuator 40. Since the unilateral mechanical actuator 40 is a mechanically positioned unit without susceptibility to back movement from the weight of the covers 10, any interruption of power merely stops the covers 10 in their travel; there is no possibility of the covers falling. Further the mechanical advantage of a unilateral mechanical actuator 40 is such that it is easily possible that one unilateral mechanical actuator 40 would be sufficient to move the covers 10. Usually more than one unilateral mechanical actuator 40 and cam actuated hinge 30 is used. When a plurality of actuators 40 exist, it is possible to overcome the failure of one actuator 40 by disconnecting the failed actuator 12 from its cover panel 12 and continue to operate the covers 10 using the remaining actuator(s) 40.

The actuators 40 are driven by an input rotating shaft 44, which is driven by a worm gear reducer 60, which in turn is driven by an electric motor 42. This ability to use electric power for positioning the hatch covers 10 is a major strength of this invention. It eliminates the need for any hydraulic fluid, chain or cable drive on ship or near the cargo hold. This both secures the cargo against the possibility of contamination from hydraulic leaks, and simplifies shipboard maintenance.

The embodiment example shows two mechanical actuators 40 driving two cam actuated hinges 30. The usual installation will have two actuators 40, while it is possible that some applications will have one actuator 40 and others may have three or more per panel, depending on panel weight and configuration. The two actuator system illustrates the principal features of the motor drive. One electric motor 42 is provided per driven panel 12A, mounted on the panel 12A which supports the actuators 40, centrally between the actuators 40, or at any convenient point adjacent to the actuators 40. The motor 42 drives a worm gear reduction box 60 through a shaft and shaft coupler 62. The gear box 60 drives two shafts 64, each connected to an actuator 40. Each shaft 64 is provided with universal joints 66 to eliminate binding as the actuator 40 pivots about its mounting clevis 56. The use of a single motor 42 and gear box 60 insures that all actuators 40 are synchronously driven, and thus the movement of each cam actuated hinge 30 is identical across the panel 12. An additional advantage of the use of unilateral mechanical actuators 40 in the inventive apparatus is that mechanical overloads may be corrected by providing mechanical disconnects **66*a* on the shafts 64, to shear if any excessive binding occurs. Since the actuator 40 maintains its last position when drive rotation stops, no possibility of undesired hatch cover panel motion exists, and the panels 12 will not fall if the disconnect 66*a* shears. This provides a simple protection against mechanical binding or jams, with a desirable outcome that motion of the covers 10 stops until the source of the problem is found and corrected. The actuators 40** will act as locks, holding their position safely.

The electric drive motor 42 is controlled through a master controller 70 which receives power from ship's power main. The motor controller 42 contains a relay, which is controlled by a control switch 72, mounted on a flexible cable 74 which may be plugged into an outlet 76 provided on the hatch cover panel side 50. This permits the operator to move around hatches 4, and directly control the opening and closing of each from a position where he can directly see and control the hatch covers 10. Limit switches 78 are provided to cut off motor motion when the cover panels 12 are in the maximum open or closed position. These limit switches 78 may be set to sense the position of the panels, or, they may count the rotation of the drive shaft 64. Since the mechanical actuator 40 is precisely and repeatably positioned in response to the rotation of its drive shaft 64, basing hatch panel 12 positioning on the rotation limits of the drive shaft 64 is sufficiently accurate and precise.

Cam Actuated Hinges 30 convert the motion of the unilateral mechanical actuator 40 into a folding motion of the hatch cover panels 12. In the example shown here, the cam actuated hinge 30 consists of two meshed hinge brackets 80, each rigidly attached to a cover panel 12; this is a strong attachment, such that movement of a hinge bracket 80 moves its attached panel 12. The brackets 80 are fastened together with, and fold around, hinge pins 82, which establish the hinge axis 54 around which the two cover panels 12 fold.

The hinge 30 is designed so that when the driving force of the actuator 40 is applied to a cam link, the cam link applies a lifting and folding force to the hinge 30 to fold the hinges 30. In this example, the cam link is two connected links. The first link is a "boomerang" or inverted L shaped hinge plate 84. This plate 84 is centered within the hinge 30; it is pivotally connected to one hinge bracket at a point 86 below the hinge axis 54. The top of the inverted L plate 84 is connected at one end 88 to a yoke 58 on the extending shaft 46 of the unilateral mechanical actuator 40, and at the other end 90 to a second link 92, which in turn is connected 94 to the second hinge plate 80.

Extension of the unilateral mechanical actuator 40 thus pushes the inverted L link 84, which, pivoting in an arc 96 above the folding axis 54 of the hinges 30, pulls up and lifts the hinge axis 54 and, pushing through the second link 92, folds down the second hinge bracket 80 against the first bracket 80. Thus when the driving side of the system is in motion, the cover panels 12 begin to rise up towards the open or stowed position.

Retraction of the unilateral mechanical actuator 40 pulls on the inverted L link 84 and second link 92, unfolding the hinge 30 and the panels 12. This motion reverses the pulling action of the L link 84, pushing down and opening the hinge 30, causing the cover 10 to move to the flat or closed position.

It is desirable to lift the hatch cover panels 12 free of the coaming 6 to protect the hatch cover seals. The wheel track 22 is shaped with an initial step rise 26, so that the motion of the panels 12 during opening is initially upwards, lifting the panels 12 sufficiently clear of the coaming 6 to prevent seal rub and wear.

In order that the folded panels 12 clear the open hold 2 to allow full access to the cargo storage spaces, the first panel coaming hinges 18 are set back so that the opened panels 12 will retract to a space clear of the hold 2. Full extension of the mechanical actuator 40 pivots the second panel 12B against the first panel 12A, raising both panels 12 into a stowed, vertical position clear of the cargo hold 2.

It can thus be seen that the disclosed electrically driven, unilateral mechanical hatch cover actuator, used in lieu of hydraulic, cable or chain actuators, provides significant operational advantages. The removal of hydraulic systems, with their attendant piping, fittings and leaks, avoids a major source of cargo contamination, by eliminating the presence of any hydraulic fluid in cargo spaces. Further, the use of a linear mechanical drive means which has no appreciable susceptibility to back motion eliminates nearly all the disadvantages, ricks to cargo and dangers attendant to the prior art hydraulic, chain and cable cover actuators, by eliminating the possibility of any mechanical failure which would result in the free fall of a hatch cover.

It can thus be seen that the invention provides for a mechanically simpler and safer cargo hatch cover actuation mechanism. While a two cover system has been described, it will be apparent to those skilled in the art how the system may be generalized to multipanel systems, and how variant power drives may be employed.

It should also be clear that, according to the invention, the unilateral mechanical actuator mechanism may be substituted for hydraulic cylinders following the structure of many of the prior art hydraulic actuated systems, providing many of the advantages shown. The example system with worm driven screw actuators mounted to a cover panel has advantages in easy mechanical synchronization of the drive to each mechanical actuator, and some such synchronization must be provided for all multi actuator systems to prevent warping the covers.

The invention therefore extends beyond the embodiments described to include equivalents to the claims.

I claim:

1. An apparatus for opening and closing a hatch having a hatch coaming with a cargo hatch cover, comprising:

the cargo hatch cover comprising a plurality of cover panels;

hinge means for connecting said cargo hatch cover to the hatch coaming and for interconnecting in succession said plurality of cover panels;

a mechanically driven actuator means attached to a particular cover panel, said actuator means for folding and unfolding said plurality of said cover panels, said actuator means having a shaft with a distal end and a threaded end, said shaft being longitudinally movable to an extended position and to a retracted position, said threaded end being driven by a gear in said actuator for moving said shaft longitudinally, said cover panels being unfolded when said shaft end is moved to said extended position so that said hatch is closed, and said cover panels being folded when said shaft is moved to said retracted position so that said hatch is open; and a cam means associated with a hinge of said particular cover panel, said cam means for causing hinging motion of said hinge under control of said distal end of said shaft and for folding and unfolding said particular cover panel relative to an adjacent cover panel so that said plurality is collectively folded and unfolded respectively.

2. The apparatus of claim 1, further comprising:

an electrical motor attached to said particular cover panel;

a gear box driven by said motor;

a drive shaft driven by said gear box, said drive shaft for driving said actuator means and for moving said shaft.

3. The apparatus of claim 1, said hinge comprising:

a first hinge bracket fixed to said particular cover panel;

a second hinge bracket fixed to said adjacent cover panel, said first and second hinge brackets being pivotally interconnected to define an axis about which said particular cover panel and said adjacent cover panel fold;

a swinging link having a lower end and an upper end, said swinging link pivotally attached at said lower end to said first hinge bracket at a point below said axis;

a fixed link having a first end and a second end, said first end being pivotally affixed to said second hinge bracket, said second end being pivotally affixed to said swinging link at said upper end; and said actuator means being connected for applying force to said swinging link at said upper end.

4. The apparatus of claim 1, wherein said actuator comprises a worm screw for driving said gear in said actuator means and further comprising an electric motor means for rotationally driving said worm screw.

5. The apparatus of claim 1, further comprising a means for inhibiting relative movement of said particular cover panel and said adjacent cover panel after said actuator means has terminated movement of said shaft.

6. The apparatus of claim 2, further comprising means associated with said drive shaft for shearing under excessive load so that said actuator is disconnected from said drive shaft.

7. The apparatus of claim 2, further comprising means for manually actuating said gear box so that said shaft is moved longitudinally.

8. The apparatus of claim 2, further comprising means for controlling power to said motor.

9. An apparatus for opening and closing a hatch having a hatch coaming with a cargo hatch cover, comprising:

the cargo hatch cover comprising a plurality of cover panels;

hinge means for connecting said cargo hatch cover to the hatch coaming and for interconnecting in succession said plurality of cover panels;

a mechanically driven actuator means attached to a particular cover panel, said actuator means for folding and unfolding said plurality of said cover panels, said actuator means having a shaft with a distal end and a threaded end, said shaft being longitudinally movable to an extended position and to a retracted position, said threaded end being driven longitudinally by the combination of a gear engaged by a worm screw situated within said actuator, said combination for inhibiting relative movement of said particular cover panel and said adjacent cover panel after said actuator means has terminated movement of said shaft, said cover panels being unfolded when said shaft end is moved to said extended position so that said hatch is closed, and said cover panels being folded when said shaft is moved to said retracted position so that said hatch is open;

a cam means associated with a hinge of said particular cover panel, said cam means for causing hinging motion of said hinge under control of said distal end of said shaft and for folding and unfolding said particular cover panel relative to an adjacent cover panel so that said plurality is collectively folded and unfolded respectively;

an electric motor attached to said particular cover panel;

a gear box driven by said motor;

a drive shaft driven by said gear box, said drive shaft for driving said worm screw for moving said shaft; and means for controlling said electric motor.

10. The apparatus of claim 9, wherein said cam means comprises:

a first hinge bracket fixed to said particular cover panel, a second hinge bracket fixed to said adjacent cover panel, said first and second hinge brackets being pivotally interconnected to define an axis about which said particular cover panel and said adjacent cover panel fold;

a swinging link having a lower end and an upper end, said swinging link pivotally attached at said lower end to said first hinge bracket at a point below said axis;

a fixed link having a first end and a second end, said first end being pivotally affixed to said second hinge bracket, said second end being pivotally affixed to said swinging link at said upper end; and said actuator means being connected for applying force to said swinging link at said upper end.

11. The apparatus of claim 10, further comprising means for shearing when excessive force is applied to said cam means by said shaft so that said shaft ceases applying force to said cam means.

12. The apparatus of claim 10, further comprising means for manually actuating said gear box so that said shaft is manually moved.

13. An apparatus for opening and closing a hatch having a hatch coaming with a cargo hatch cover, comprising:

(a) the cargo hatch cover comprising a plurality of cover panels;

(b) hinge means for connecting said cargo hatch cover to the hatch coaming and for interconnecting in succession said plurality of cover panels;

(c) a mechanically driven actuator means attached to a particular cover panel, said actuator means for folding and unfolding said plurality of said cover panels, said actuator means having a shaft with a distal end and a threaded end, said shaft being longitudinally movable to an extended position and to a retracted position, said threaded end being driven longitudinally by the combination of a gear engaged driven by a worm screw situated within said actuator, said combination for inhibiting relative movement of said particular cover panel and said adjacent cover panel after said actuator means has terminated movement of said shaft, said cover panels being unfolded when said shaft end is moved to said extended position so that said hatch is closed, and said cover panels being folded when said shaft is moved to said retracted position so that said hatch is open;

(d) a cam means associated with a hinge of said particular cover panel, said cam means for causing hinging motion of said hinge under control of said distal end of said shaft and for folding and unfolding said particular cover panel relative to an adjacent cover panel so that said plurality is collectively folded and unfolded respectively, said cam means comprising:

(1) a first hinge bracket fixed to said particular cover panel, a second hinge bracket fixed to said adjacent cover panel, said first and second hinge brackets being pivotally interconnected to define an axis about which said particular cover panel and said adjacent cover panel fold;

(2) a swinging link having a lower end and an upper end, said swinging link pivotally attached at said lower end to said first hinge bracket at a point below said axis, said swinging link for receiving force from said actuator means at said upper end; and (3) a fixed link having a first end and a second end, said first end being pivotally affixed to said second hinge bracket, said second end being pivotally affixed to said swinging link at said upper end;

(e) an electric motor attached to said particular cover panel;

(f) a gear box driven by said motor;

(g) a drive shaft driven by said gear box, said drive shaft for driving said worm screw for moving said shaft;

(h) means for controlling said electric motor; and (i) means for shearing when excessive force is applied to said cam means by said shaft so that said shaft ceases applying force to said cam means.

* * * * *